US008910855B2

(12) United States Patent
Wong et al.

(10) Patent No.: US 8,910,855 B2
(45) Date of Patent: Dec. 16, 2014

(54) FOLDABLE BOXES

(71) Applicant: Papillon Ribbon & Bow, Inc., Clifton, NJ (US)

(72) Inventors: Chi Yin Wong, Clifton, NJ (US); Vanessa Hui, Kowloon (HK)

(73) Assignee: Papillon Ribbon & Bow, Inc., Clifton, NJ (US)

( * ) Notice: Subject to any disclaimer, the term of this patent is extended or adjusted under 35 U.S.C. 154(b) by 0 days.

(21) Appl. No.: 14/266,363

(22) Filed: Apr. 30, 2014

(65) Prior Publication Data

US 2014/0231495 A1 Aug. 21, 2014

Related U.S. Application Data

(63) Continuation-in-part of application No. 11/113,437, filed on Apr. 22, 2005.

(51) Int. Cl.
*B65D 5/32* (2006.01)
*B65D 5/36* (2006.01)

(52) U.S. Cl.
CPC ..... *B65D 5/3635* (2013.01)
USPC ..... 229/122.34; 229/122.32; 229/160.2

(58) Field of Classification Search
USPC ..... 229/122.21, 122.32, 122.34, 160.2, 229/178, 117.03, 117.07, 117.08
See application file for complete search history.

(56) References Cited

U.S. PATENT DOCUMENTS

| | | | | |
|---|---|---|---|---|
| 317,795 | A * | 5/1885 | Jaeger | 229/186 |
| 1,600,396 | A * | 9/1926 | Campbell et al. | 229/199 |
| 4,241,829 | A * | 12/1980 | Hardy | 229/178 |
| 4,458,838 | A * | 7/1984 | Lacasa et al. | 229/122.32 |
| 5,823,424 | A * | 10/1998 | Allen | 229/198 |
| 7,481,355 | B2 * | 1/2009 | Hui | 229/117.08 |
| 2006/0151586 | A1 * | 7/2006 | Kao | 229/117.08 |
| 2010/0314436 | A1 * | 12/2010 | Tao | 229/199 |

* cited by examiner

*Primary Examiner* — Gary Elkins
(74) *Attorney, Agent, or Firm* — Feldman Law Group, P.C.; Stephen E. Feldman

(57) ABSTRACT

A foldable box that is interchangeable from a flat configuration to a three-dimensional configuration. The foldable box includes a first set of panels, a second set of panels and a third set of panels. The second set of panels and the third set of panels can be adhesively and foldably connected to the first set of panels to form the foldable box.

15 Claims, 13 Drawing Sheets

FOLDABLE BOXES

CROSS-REFERENCE TO RELATED APPLICATION

This application is a continuation-in-part of application Ser. No. 11/113,437, filed Apr. 22, 2005, now pending. The patent application identified above is incorporated here by reference in its entirety to provide continuity of disclosure.

BACKGROUND

The disclosed technology relates to a foldable box. More particularly, to a box that is stored flat and folds into a three-dimensional box.

Boxes are used everyday for many purposes. They are used for storage, shipping and even gift-giving. Because of the variety of uses, boxes come in a variety of sizes and shapes. From boxes that hold a small piece of jewelry to ones that hold refrigerators.

But when a box is manufactured by a manufacturing company the box is usually shipped in a three-dimensional form. The manufacturing company than must pay for additional shipping cost for empty space within the box. Additionally, the boxes are also more susceptible to damage when shipped in this fashion.

To overcome these shipping problems, box designers have made collapsible boxes. These boxes are shipped flat and need to be constructed by the ultimate user of the box.

To construct these boxes, the user must unfold the box and place certain folds into certain slots, or in the alternative use glue or tape. These actions are time consuming and labor intensive. Stores must pay for this extra time to construct these boxes. The consumer at the store also has a delay because the boxes will usually be constructed in front of the consumer. This delay results in loss time for all parties involved.

Some stores in order not to delay the customer may employ extra personnel to build boxes. This, however, does not alleviate all of the stores' problems because now the store must find space to store the boxes in their three-dimensional form. This means there will be less space for the products which they stock.

SUMMARY

The present invention overcomes the problem of the conventional art by constructing a foldable box that is stored in a flat position. In order to fold the box into a three-dimensional position, all a user must do is unfold two sides of the box which will in turn construct the foldable box.

In one implementation, a foldable box having a flat configuration and a three-dimensional configuration, comprising: a first set of panels, the first set of panels having a first main panel, a second main panel, a first sub-panel, a second sub-panel and a third sub-panel, the first sub-panel being attached to a first main panel at a first crease, the second sub-panel being attached to a first main panel at a second crease, the second sub-panel being attached to a second main panel at a third crease, the third sub-panel being attached to a second main panel at a fourth crease; a second set of panels, the second set of panels including a rear support panel having a first connecting tab foldably connected at a fifth crease and a front support panel having a second connecting tab foldably connected at a sixth crease, the rear support panel being attached to second sub-panel with the fifth crease coinciding with the second crease, the front support panel being attached to the third sub-panel with the sixth crease coinciding with an exterior edge of the third panel; and a third set of panels, the third set of panels including a right-side panel having a third connecting tab foldably connected at a seventh crease and a left-side panel having a fourth connecting tab foldably connected at an eighth crease, the right-side panel being attached to the second main panel with the seventh crease coinciding with a first exterior edge of the second main panel, the left-side panel being attached to the second main panel with the eighth crease coinciding with a second exterior edge of the second main panel.

In some implementations, attachment tape can be used, securing the first tab, the second tab, the third tab and the fourth tab to their respective panels, and also being capable of reinforcing the third crease and the fourth crease.

In some implementations, the right-side panel can include two attachment wings foldably connected to the right-side panel and the left-side panel can include two attachment wings foldably connected to the left-side panel, each attachment wing having a first triangular connector and a second triangular connector foldably connected to one another where the second triangular connector of one of the attachment wings for the right-side panel is connected to the second sub-panel and the second triangular connector of the other attachment wing for the right-side panel is connected to the third sub-panel and wherein the second triangular connector of one of the attachment wings for the left-side panel is connected to the second sub-panel and the second triangular connector of the other attachment wing for the left-side panel is connected to the third sub-panel.

In some implementations, the foldable box can include a first magnet and a second magnet for securely closing the three-dimensional configuration of the foldable box, the first and second magnet having opposite poles.

In some implementations, the foldable box can include a first cut-out, the first cut-out being formed on a top edge of the rear support panel; and a second cut-out, the second cut-out being formed on a top edge of the front support panel, wherein the first cut-out and the second cut-out can be used to disassemble the three-dimensional configuration of the foldable box.

In some implementations, reinforcement tape can be used for reinforcing the first crease and the second crease. In some implementations, protection foam may be utilized, the protection foam being secured to an underside of the first main panel.

BRIEF DESCRIPTION OF THE DRAWINGS

The following description of preferred embodiments of the present invention will be better understood when read in conjunction with the appended drawings. It should be understood, however, that the invention is not limited to the precise arrangements shown.

DETAILED DESCRIPTION

Manufacturers of boxes often run into difficulty when shipping boxes because of the way in which they are shipped. To cut down on shipping cost it is more cost efficient to ship boxes in a flat position. However, flat boxes must be assembled by the party to which it is shipped. This takes time on the part of the ultimate user.

To cut down on this time, a box can be constructed in such a way as to make the assembly time to construct a box minimal. This is accomplished by having foldable connectors attached to certain parts of the box. When the box is flat the connectors are also flat. To construct a box a user must only lift the sides of the box. This triggers a chain reaction and as the user lifts the sides the connectors in turn pull other parts of the box. The box is then fully three-dimensional with minimal work on the part of the user. The user will not have to add any additional glue or tape to the box.

The boxes may be constructed out of any material that may be foldably connected such as all types of cardboard and flexible plastics. The material may also be decorated so the box is aesthetically pleasing to the eye. This is accomplished by lining the material with certain types of laminate and cloth-like materials.

Figure 1:
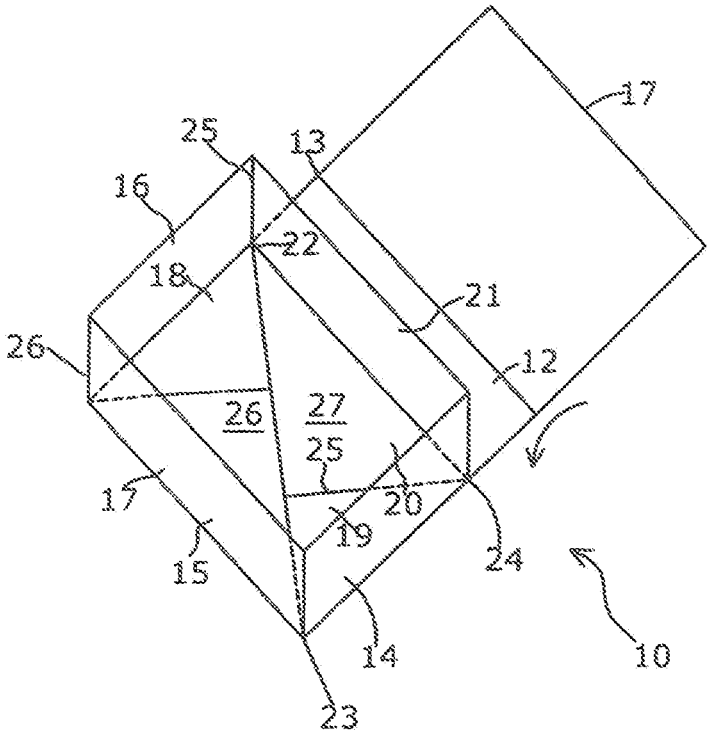
FIG. 1 is a perspective view of the first embodiment of the present invention in its constructed form.

FIG. 1 is one embodiment of the present invention. In FIG. 1, the box 10 is in its three-dimensional form. The box has a cover 11 that is foldably connected to an outside connector 12 at crease 13. The outside connector is also foldably connected to the bottom of the box not shown) at crease 22.

The boxes have a right side 14, a front side 15, a left side 16 and a rear side 21. Right side 14 is foldably connected to front side 15 at crease 23. Front side 15 is foldably connected to left side 16 at crease 26. Left side 16 is foldably connected to rear side 21 at crease 22. Rear side 21 is foldably connected to right side 14 at crease 24.

The box also has a front connector 26 having portions 17 and 18 and rear connector having portions 19 and 20. Portion 18 of the front connector is adhered to the bottom of the box and is foldably connected to the bottom of the left side 16. Portion 17 is foldably connected to portion 18 and the bottom side of the front side 17.

The rear connector 27 is connected between the bottom of back side 21 and the bottom of right side 14. The rear connector is folded in two parts at crease 25.

FIG. 1 shows the box in its constructed form with the sides 14, 15. 16 and 21 in an upright position. The connectors 26 and 27 are on top of the bottom portion not allowing the bottom to visible.

Figure 2:
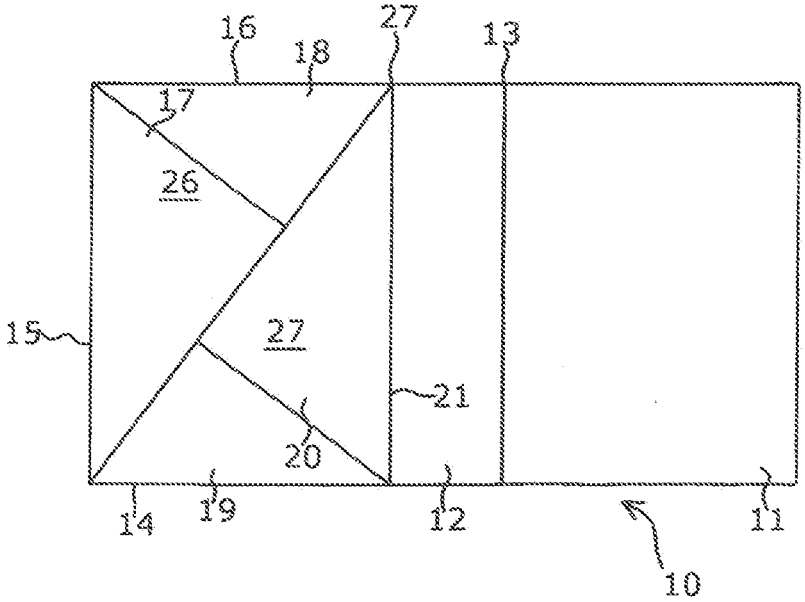
FIG. 2 is a top view of the first embodiment of the present invention in its constructed form.

FIG. 2 shows the foldable box 10 from a top view in its constructed position. From this view point, the bottom of the box is split into four sections. Sections 17 and 18 represent one connector 26 and sections 19 and 20 represent the second connector 27. These connectors 26 and 27 when in their unfolded state cover the entire bottom layer of the box.

The cover is connected to connector 12 at crease 13. If a user wanted to close the box 10, the user will lift the cover 11 and fold the cover over the opening created by sides 14, 15, 16 and 21. The connector 12 then rests on side 21.

Figure 3:
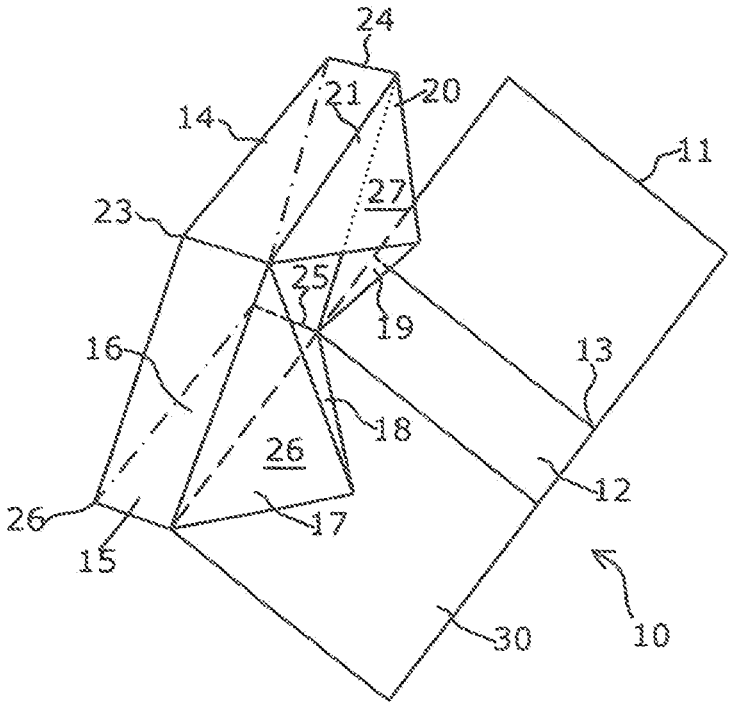
FIG. 3 is a perspective view of the first embodiment of the present invention in its transition from a flat unfolded box to its constructed form.

FIG. 3 shows the box in use as the box is folded from a flat state to a box shape. The sides 14, 15, 16 and 21 are shown. These sides are all interconnected as discussed above.

One portion of the connector 18 is adhered to the bottom of the box 30 and is connected to side 15 at crease 31. A second portion of the connector 18 is connected to the bottom of side 14.

Connector 27 is connected to the bottom of side 16 and 21. The connector 27 while opening forms a triangular shape.

The bottom 30, cover 11 and connector 12 all remain flat while the sides of the box are formed.

Figure 4:
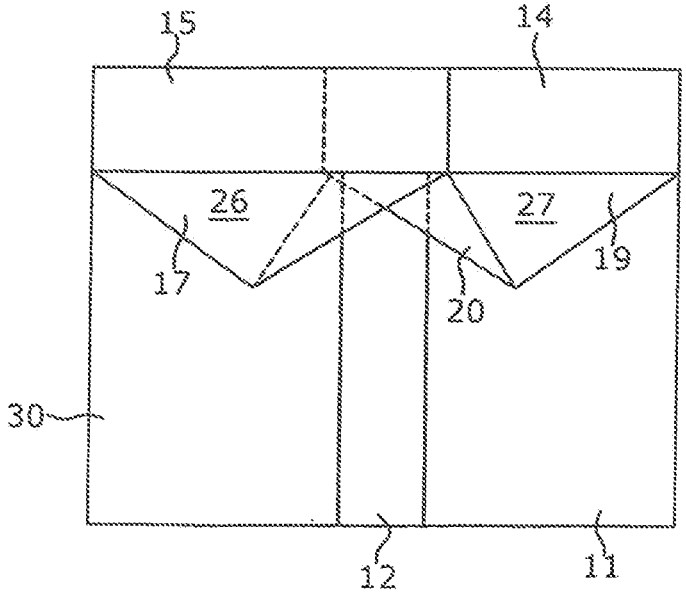
FIG. 4 is a top view of the first embodiment of the present invention in its flat, unfolded form.

FIG. 4 shows the box in its flat position. Sides 14 and 15 are visible from the top while sides 16 and 21 are covered by sides 14 and 15.

Connectors 26 and 27 are also folded so as to form two triangular areas.

Figure 5:
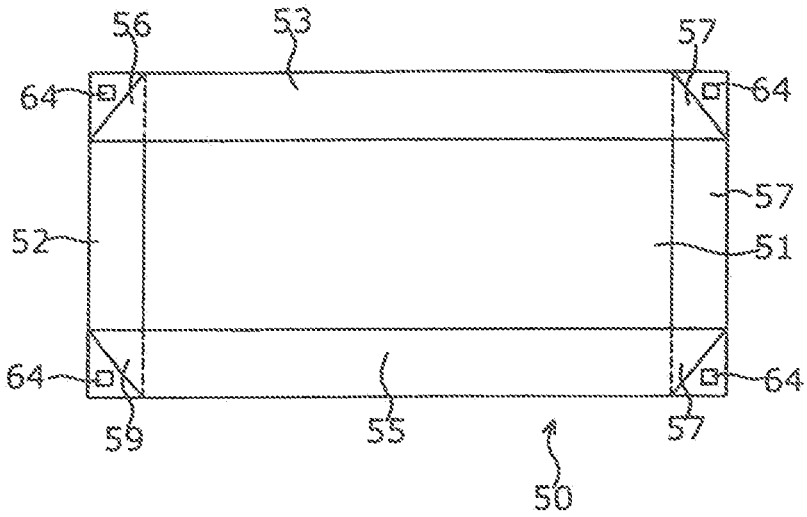
FIG. 5 is a top view of the second embodiment of the present invention in its flat, unfolded form.

FIG. 5 is another embodiment of the foldable box. This foldable box 50 has a cover which is separately assembled and is not foldably connected to the box.

In this embodiment the box 50 has a bottom 51 and four sides 52, 53, 54 and 55. The sides 52, 53, 54 and 55 are foldably connected to the bottom by four connectors 56, 57, 58, 59 located in the corners of the box.

Figure 6:
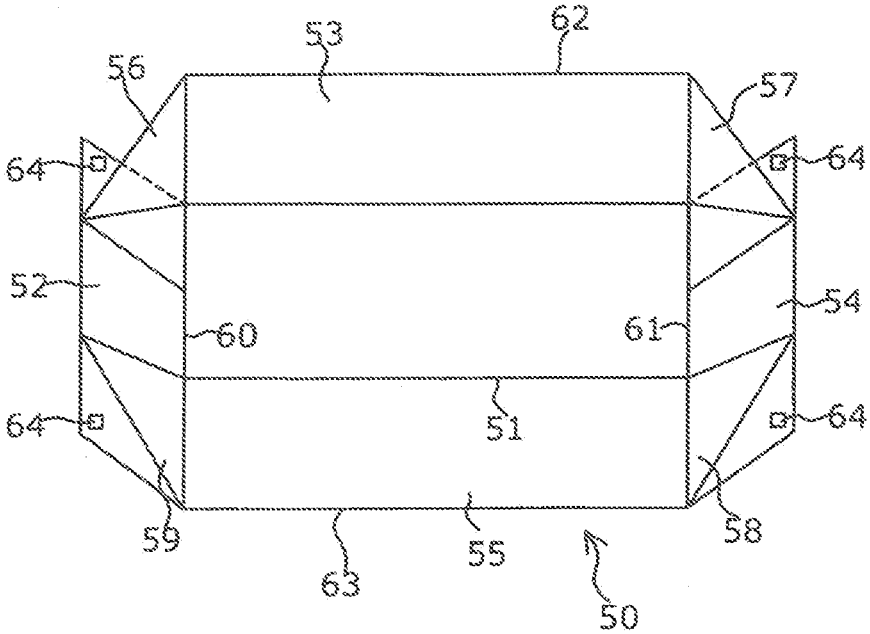
FIG. 6 is a perspective view of the second embodiment of the present invention in its transition from a flat unfolded box to its constructed form.

FIG. 6 shows the box in a partially assembled state. Here, sides 52 and 54 are connected to the bottom at crease. Sides 52 and 54 are also connected to the bottom at crease 60 and 61.

Also shown are the four connectors 56-59. These connectors 56-59 are foldably attached to the edge of each side. That is, side 52 is attached to side 53 by connector 56. Side 53 is attached to side 54 by connector 57. Side 54 is attached to side 55 by connector 58. Side 55 is attached to side 52 by connector 59.

Also shown on sides 52 and 54 are additional means 64 for ensuring that the sides of the box are tightly in place. This makes sure that when a user folds the box 50, the box 50 will not inadvertently collapse while in use.

The additional means 64 can be an adhesive, tape or Velcro strip. This additional means 64 is already in place when a user assembles the box. The user does not need any additional items to make the box.

A securing means (not shown) can also be attached to a side of the box as will be discussed in detail in FIGS. 8-10. This securing means adds additional strength to the box when the box is constructed by a user. That is, when the sides are in their upright position the securing means ensures the box will not collapse when the box is in use.

Figure 7:
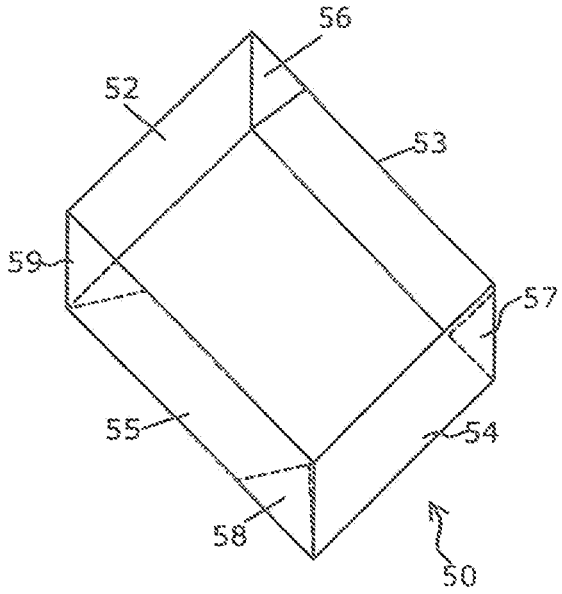
FIG. 7 is a perspective view of the second embodiment of the present invention in its constructed form.

FIG. 7 shows the box in its constructed state. The sides 52-55 are in their upright position with the bottom face down. The additional securing means 64 are not visible when the box 50 in its constructed state.

Figure 8:
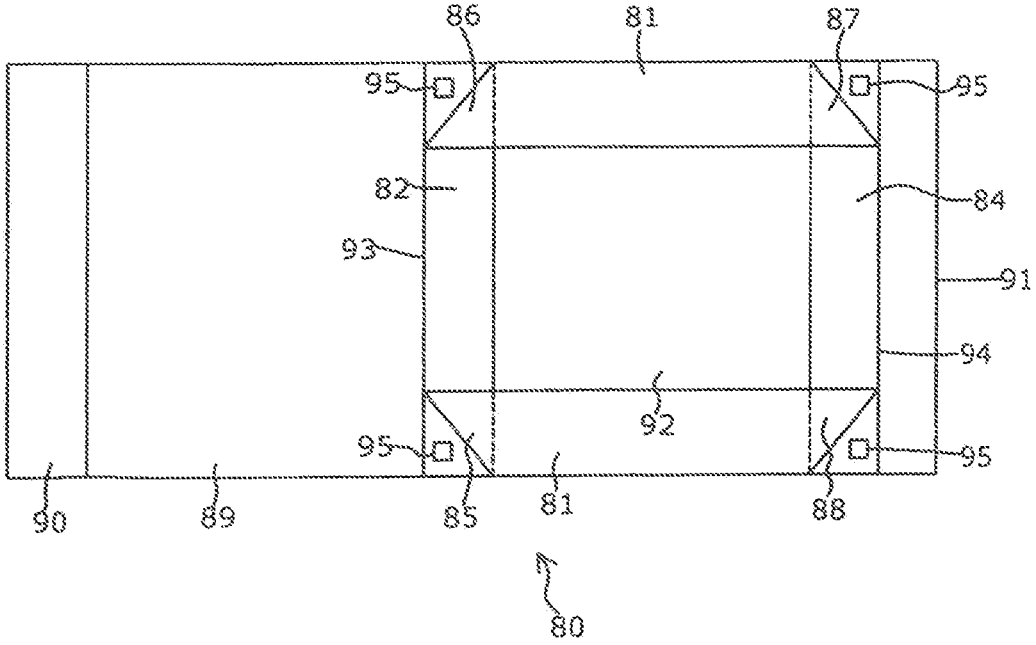
FIG. 8 is a top view of the third embodiment of the present invention in its flat, unfolded form.

FIG. 8 shows a third embodiment of the present invention. In this embodiment, the sides 81-84 and the bottom 92 are constructed as in the second embodiment. However, in this embodiment the cover 89 is integrated into the construction of the box 80. During shipping, when the box 80 is in its flat state, the cover 89 and lip 90 may be turned 180 degrees and stored against the bottom 92 of the box 80.

The sides 81-84 are constructed with a cover 89 being foldably attached to side 82 at crease 93. The cover 89 is then attached to lip 90 for securing the cover 89 to the constructed box 80 at side 84.

A securing means 91 is attached to side 84 at crease 94. This securing means 91 adds additional strength to the box when the box is constructed by a user. That is, when the sides are in their upright position, the securing means is placed between 81 and 83. This ensures the box 80 will not collapse when the box 80 is in use.

The box also may have additional means 95 for ensuring that the sides of the box are tightly in place. The additional means 95 can be an adhesive, tape or Velcro strip. This additional means 95 is already in place when a user assembles the box. The user does not need any additional items to make the box.

Figure 9:
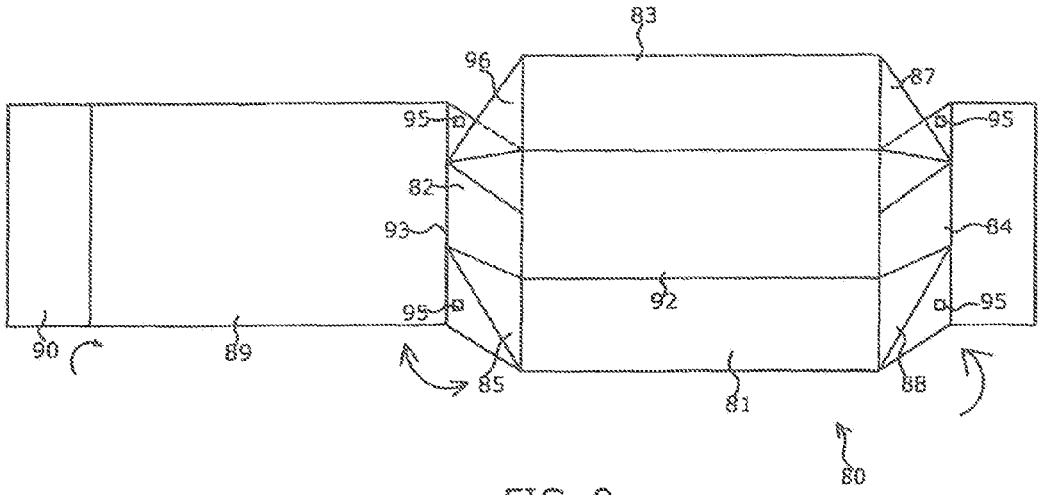
FIG. 9 is a perspective view of the third embodiment of the present invention in its transition from a flat unfolded box to its constructed form.

FIG. 9 shows the box 80 in a transition state between folded and unfolded. The box 80 as it is being lifted from its unfolded state will raise the sides 81-84 of the box 80.

Figure 10:
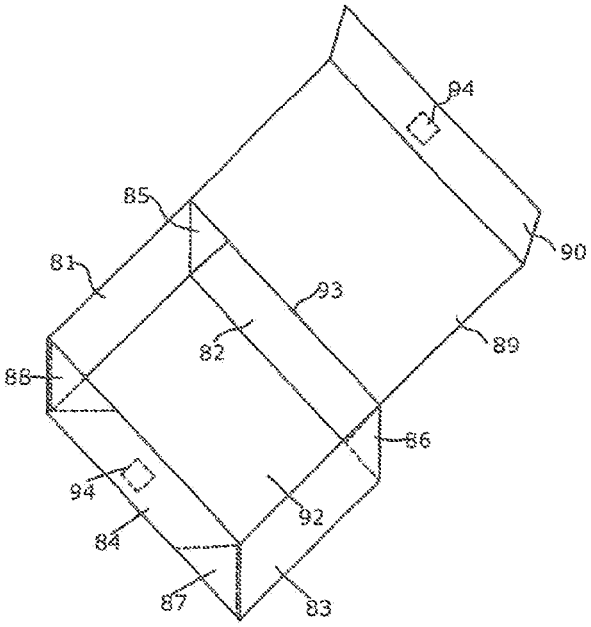
FIG. 10 is a perspective view of the third embodiment of the present invention in its constructed form.

FIG. 10 shows the box 80 with the sides 81-84 raised. To fully close the box 80, the cover 89 is thrown over the open area created by the sides 81-84. The cover 80 is then secured as a lid to the sides by the use of a locking means 94 such as a magnet which may be located between the surfaces of the box. However, other types of locking means such as snaps may be placed on the lip and the sides to lock the cover 89 in place.

In another implementation of a foldable box in accordance with the disclosed technology, a foldable box is interchangeable from a flat configuration to a three-dimensional configuration. The foldable box can include a first set of panels, a second set of panels and a third set of panels, the second set of panels and the third set of panels being adhesively and foldably connected to the first set of panels to form the foldable box.

Figure 11A:
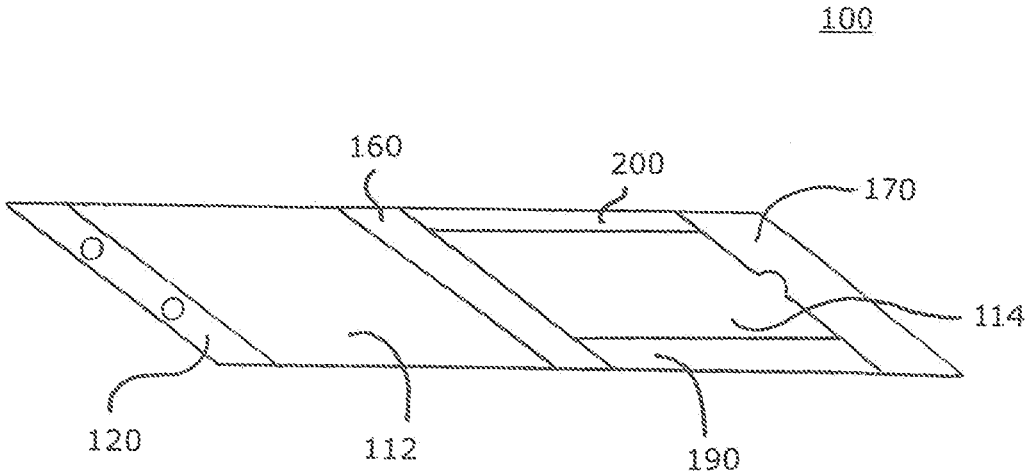
FIG. 11*a* is a perspective view of one implementation of the disclosed technology in a flat configuration.
Figure 11B:
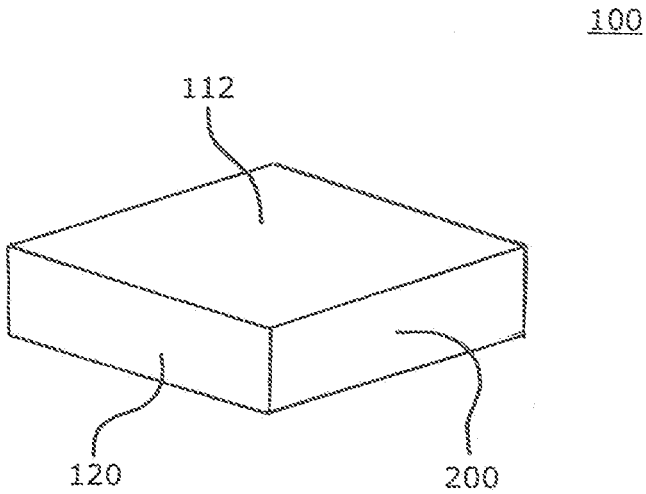
FIG. 11*b* is a perspective view of one implementation of the disclosed technology in a three-dimensional configuration.

Referring to FIGS. 11*a-b*, the foldable box 100 can have a first flat configuration in which box 100 is flat (see FIG. 11*a*), and a second three-dimensional configuration in which the box is built upright (See FIG. 11*b*). The second configuration is transferable to the first flat configuration and vice versa. The foldable box 100 includes a first set of panels 110, a second set of panels 150 and a third set of panels 180 arranged and secured to one another in a predefined fashion. In one embodiment, the size of the three-dimensional foldable box 100 may be 15-30 cm (l)×12-24 cm (w)×2-10 cm (h). Larger and smaller sizes are possible.

Each set of the panels 110, 150, 180 can include panels that are preferably rectangular in shape and can be made from a substrate such as paperboard, cardboard, flexible plastic, or any other suitable substrate. In some implementations, the substrate can be laminated with a predefined material. In some implementations, the laminate can be decorated so the box is aesthetically pleasing to the eye. This is accomplished by lining the substrate with certain types of decorative laminate and cloth-like materials.

Figure 12:
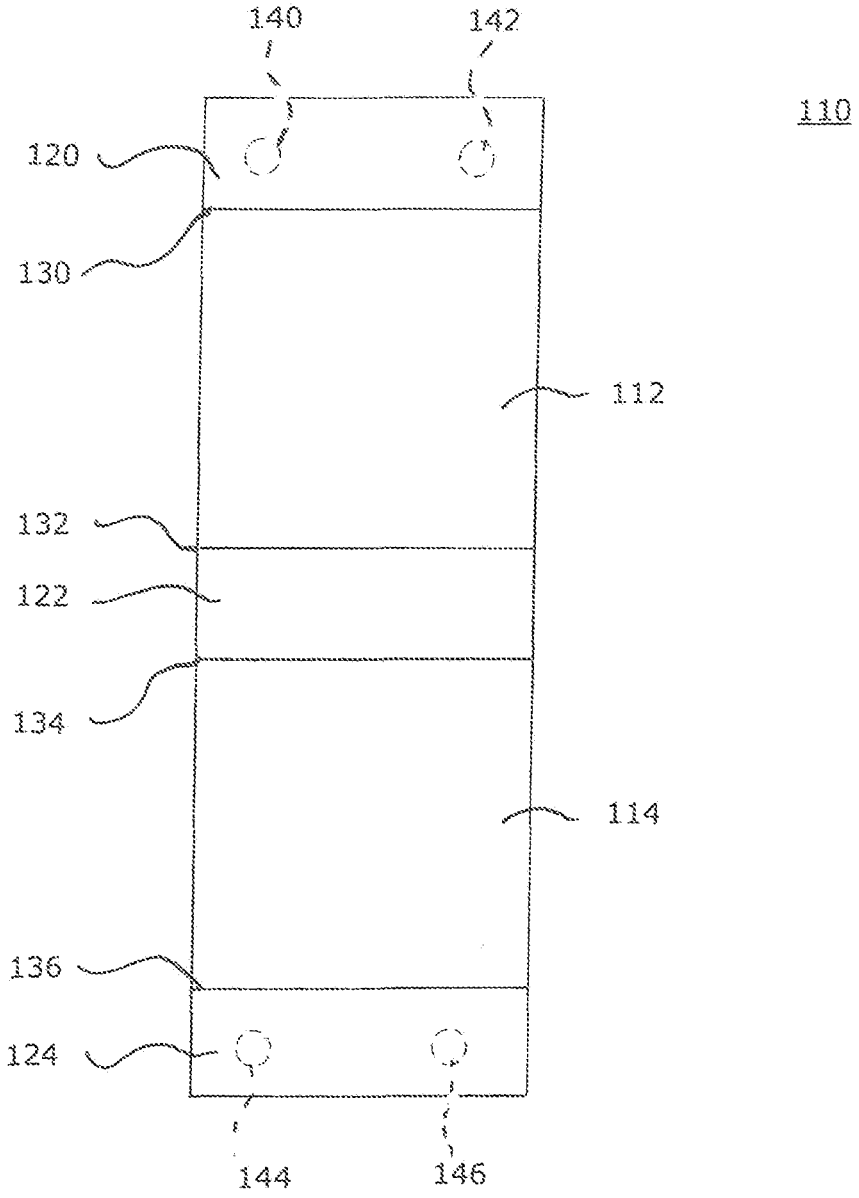
FIG. 12 is a top view of a first set of panels in one implementation of the disclosed technology.

Referring to FIG. 12, a first set of panels 110 is shown. The first set of panels 110 can include a plurality of panels that are coupled in a predefined fashion along predefined creases/folds. The first set of panels 110 can have two classes of panels, e.g., main panels and sub-panels. Main panels are preferably bigger than sub-panels. In some implementations, lengths of main panels and sub-panels can be approximately identical, whereas widths of the main panels can be two to five times the widths of sub-panels.

A first main panel 112 has approximately identical dimensions as that of a second main panel 114. Panels 120, 122 and 124 define sub-panels that have approximately identical dimensions. Sub-panel panel 120 is coupled to first main panel 112. Sub-panel 122 is coupled between first main panel 112 and second main panel 114. Sub-panel panel 124 is coupled to second main panel 114. Sub-panels 120 and 122 are foldable relative to panel 112 along creases 130 and 132, respectively. Sub-panels 122 and 124 are foldable relative to second main panel 114 along creases 134 and 136, respectively. The main panels and sub-panels are preferably laminated to define a uniform construction of the first set of panels 110. The first set of panels 110 including main panels and sub-panels can be made by die cutting, scoring and then folding to define a desired combination of main panels and sub-panels in a single piece.

The first set of panels 110 can also include an inbuilt magnetic locking arrangement 140, 142, 144, 146. That is, sub-panels 120 and 124 can include magnets 140, 142, 144, 146. The magnets 140, 142, 144, 146 can be positioned within the sub-panels 120 and 124 preferably below the lamination. The magnets 140, 142, 144, 146 can be positioned in the respective sub-panel such that the magnets are not visible with the naked eye from the sub-panel. Thickness of each of the magnets 140, 142, 144, 146 can be substantially close to the thickness of the respective sub-panels 120, 124. Magnets 140, 142 have opposite polarity to that of magnets 144, 146. The magnets 140, 142, 144, 146 can be positioned in the respective sub-panels 28 and 30 so that the magnets can be mated when the box 100 is in a closed position. In some implementations, one set of magnets can be replaced with a magnetically attractive material, e.g. a ferric metal.

Figure 13:
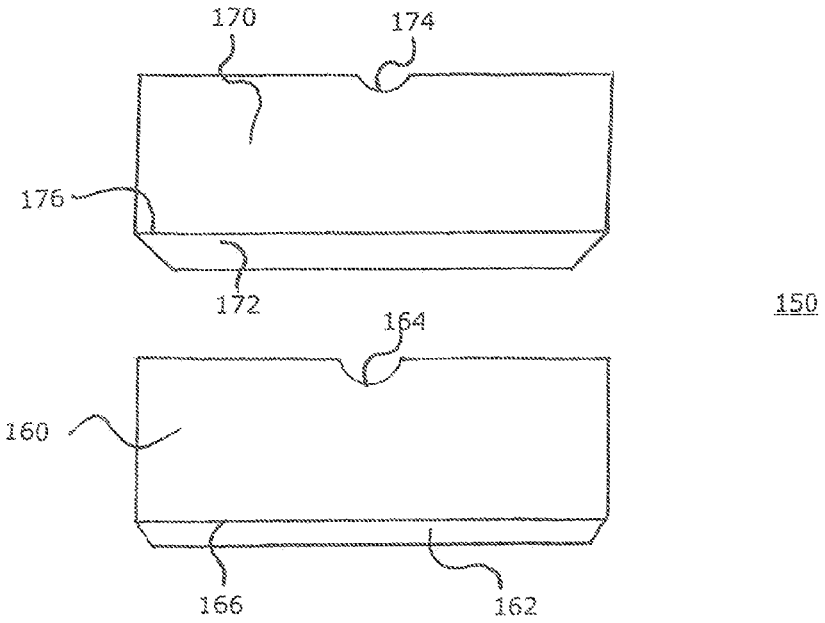
FIG. 13 is a top view of a second set of panels in one implementation of the disclosed technology.

Referring to FIG. 13, a second set of panels 150 is shown that includes a rear support panel 160 and a front support panel 170. The rear support panel 160 can be a rectangular panel that includes a cutout 164 and an attachment tab 162. The attachment tab is coupled to the rear support panel at crease 166. The front support panel 170 can be a rectangular panel that includes a cutout 174 and an attachment tab 172. The attachment tab 172 can be coupled to the front support panel 170 at crease 176.

Figure 14:
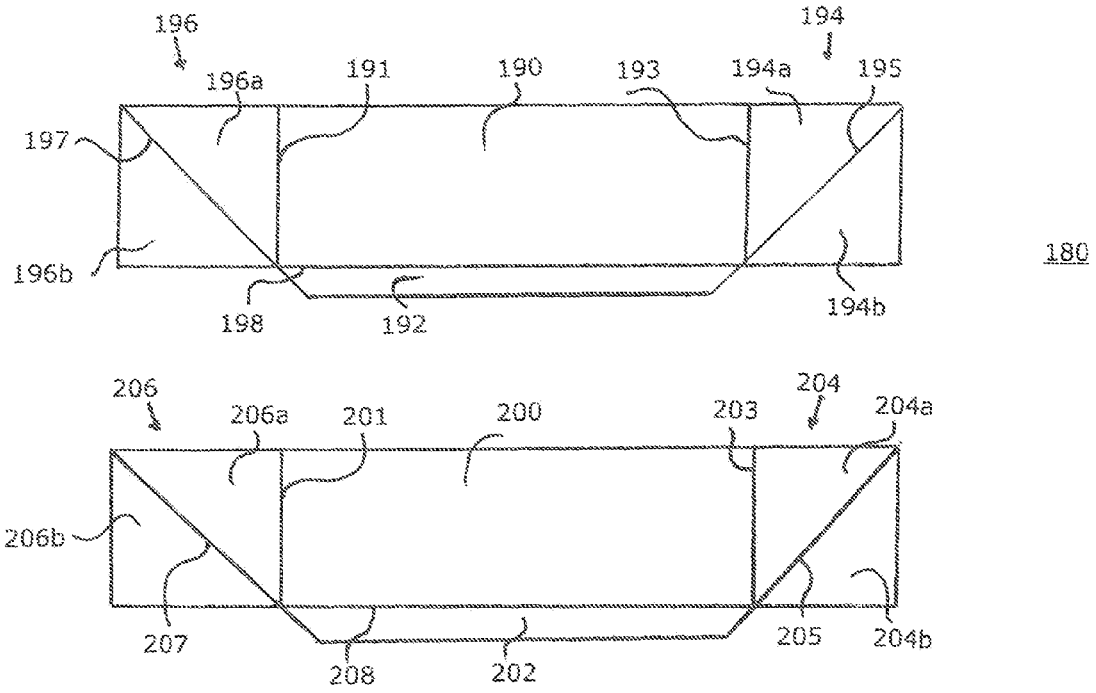
FIG. 14 is a top view of a third set of panels in one implementation of the disclosed technology.

Referring to FIG. 14, a third set of panels 180 is shown that includes a right-side panel 190 and a left-side panel 200. The right-side panel 190 can be a rectangular panel that includes an attachment tab 192 and a pair of attachment wings 194, 196. The attachment wings 194, 196 are foldably connected to the right-side panel 190 at crease 193, 191, respectively. The pair of attachment wings 194, 196 include diagonal folds 195, 197 that respectively define triangular connectors 194*a-b*, 196*a-b*. The attachment tab 192 can be coupled to the right-side panel 190 at crease 198. The left-side panel 200 can be a rectangular panel that includes an attachment tab 202 and a pair of attachment wings 204, 206. The pair of attachment wings 204, 206 are foldably connected to the left-side panel at crease 203, 201, respectively. The pair of attachment wings 204, 206 include diagonal folds 205, 207 that respectively define triangular connectors 204*a-b*, 206*a-b*. The attachment tab 202 can be coupled to the right-side panel 200 at crease 208.

Figure 15:
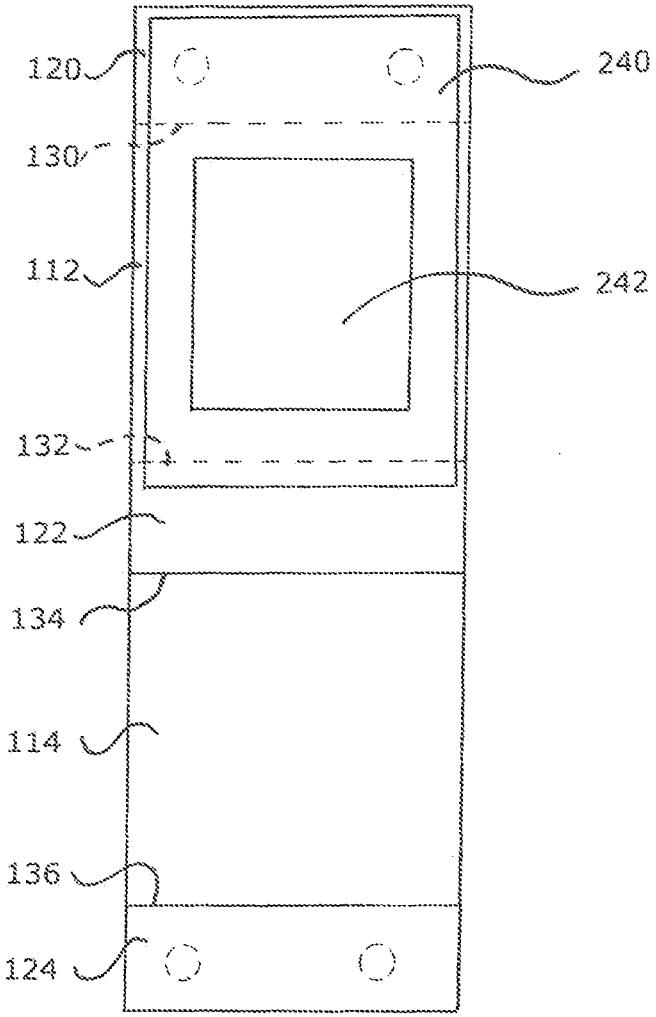
FIG. 15 is a top view of a first set of panels with reinforcement tape in one implementation of the disclosed technology.
Figure 16:
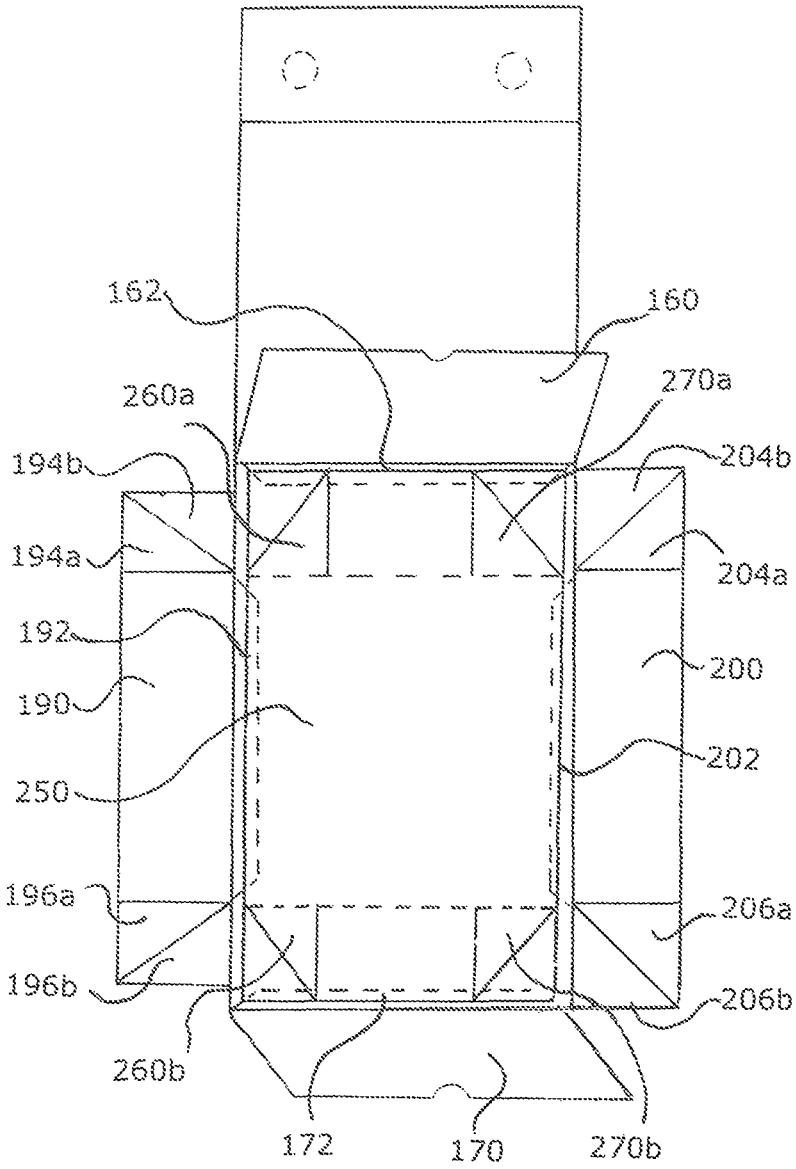
FIG. 16 is a top view of a first set of panels with a second set of panels and a third set of panels attached using attachment tape in one implementation of the disclosed technology.
Figure 17:
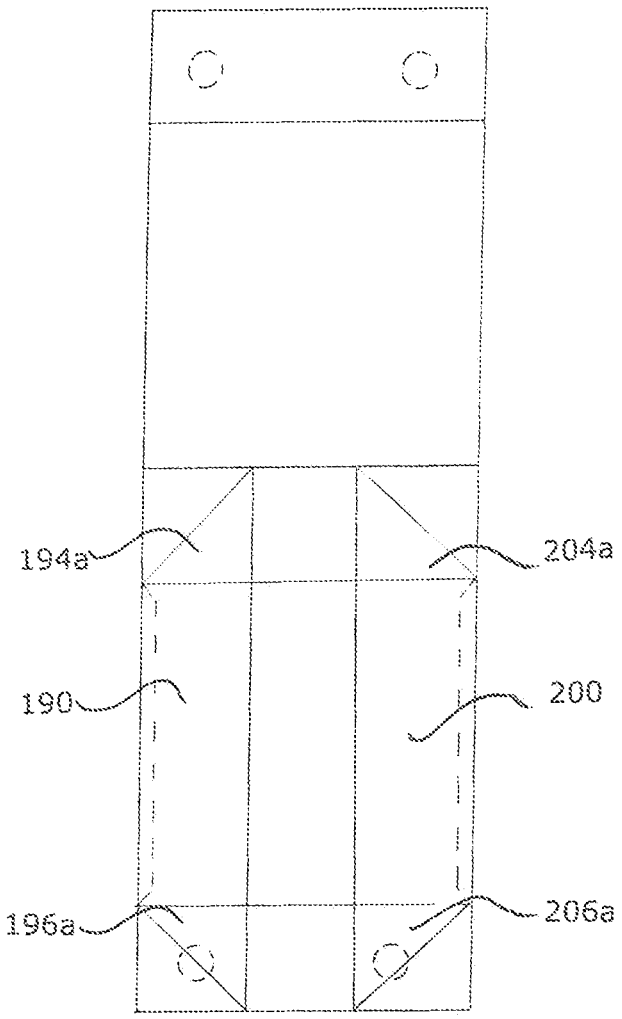
FIG. 17 is a top view of a first set of panels with a third set of panels attached and in a flat position with respect to the first set of panels in one implementation of the disclosed technology.
Figure 18:
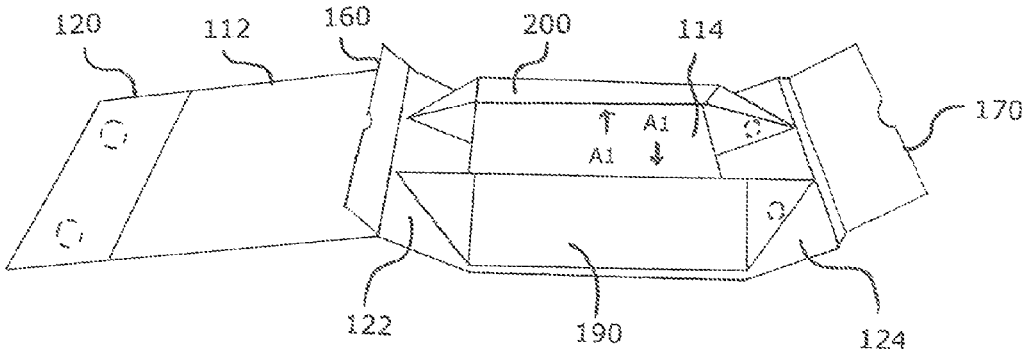
FIG. 18 is a perspective view of one implementation of the disclosed technology in its transition from a flat configuration to a three-dimensional configuration.
Figure 19:
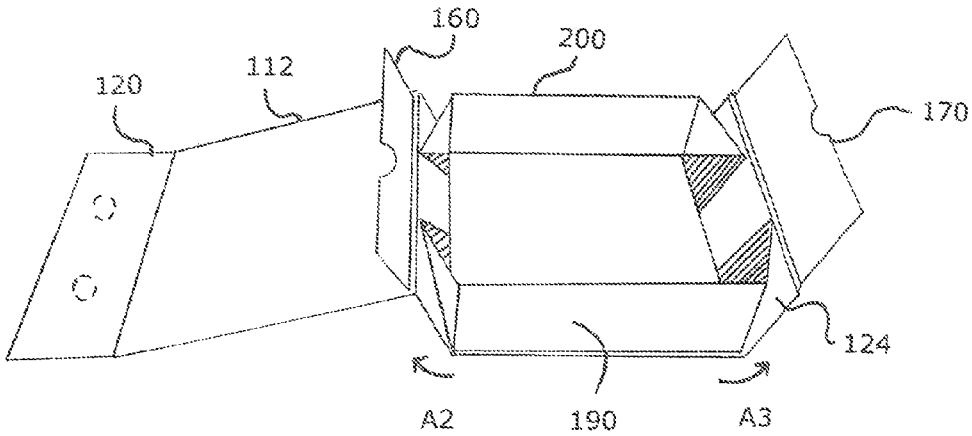
FIG. 19 is a perspective view of one implementation of the disclosed technology in its transition from a flat configuration to a three-dimensional configuration.

FIGS. 15-17 show various stages of the construction of the foldable box. These stages can be performed in any order and for sake of clarity FIGS. 15-17 each show a single stage of construction.

As shown in FIG. 15, the first set of panels 110 can laminated with a first piece of protection paper 240. The protection paper 240 can be applied to an interior side of the first set of panels 110 with an adhesive or the protection paper 240 can be a type of adhesive tape. The protection paper 240 is partially applied to the first set of panels 110. That is, the perimeter of the protection paper 240 is in close proximity to the exterior edges of panel 120 and main panel 112 and extends onto panel 122 just slightly over crease 132. The protection paper provides support for crease 130 and 132. A protective layer 242 can also be applied to the interior side of the first set of panels 110 and used as a protection for contents within the foldable box 100. That is, the protective layer 242 can be formed from a foam-like material having a pre-defined thickness of approximately 0.1-1 mm.

As shown in FIG. 16, the second set of panels 150 and the third set of panels 180 can be attached to the first set of panels 110 using attachment tape 250. That is, the rear support panel 160, the front support panel 170, the right-side panel 190 and the left-side panel 200 can be arranged with respect to the first set of panels 110 so that (1) the crease 166 of the rear support panel 160 is coincident with crease 132 and the tab 162 is laid on the sub-panel 122, (2) the crease 176 of the front support panel 170 is coincident with an exterior edge of panel 124 and the tab 172 is laid on the sub-panel 124, (3) the crease 196 of the right-side panel 190 is coincident with a right exterior edge of the main panel 114 and the tab 192 is laid on the main panel 114, (4) the crease 206 of the left-side panel 200 is coincident with a left exterior edge of the main panel 114 and the tab 202 is laid on the main panel 114. Once arranged, attachment tape 250 is adhered to the first set of panels with a portion of the tabs 172, 182, 192 and 202 being beneath the attachment tape 250 and the perimeter of the protection paper 250 is in close proximity to the exterior edges of panel 124 and main panel 114 and extends onto panel 122 just slightly before crease 132. In other words, the attachment tape 250 adheres the second and third panels 150, 180 to the first panels 110 and provides support for creases 134 and 136. In some implementations, the tabs 172, 182, 192, 202 can be directly adhered to the main panel 114 with adhesive glue.

As shown in FIG. 17, triangular connectors 194*b*, 196*b* of the right-side panel 190 are attached to sub-panels 122 and 124 at connection surfaces 260*a*, 260*b*, respectively and the triangular connectors 204*b*, 206*b* of the left-side panel 200 are attached to sub-panels 122 and 124 at connection surfaces 270*a*, 270*b*, respectively. The connectors are attached to their respective panels using an adhesive, e.g., adhesive glue. The attachments wings are folded onto each other so that 194*a* lays on 194*b*, 196*b* lays on top of 196*a*, 204*a* lays on 204*b* and 206*b* lays on top of 206*a*. The right-side panel 190 and the left-side panel 200 is folded over so the panel is laid flat onto the main panel 114.

Referring to FIGS. 18-21, a folding assembly of the first set of panels 110, the second set of panels 150 and the third set of panels 180 is described that defines the first closed configuration of the foldable box in accordance with the disclosed technology. In the first closed position, the first set of panels 110, the second set of panels 150 and the third set of panels 180 are completely folded in the first closed position. (See FIG. 11*a*). In a next step the right and left panels 190 and 200 are pulled upward (see FIG. 18) to separate the right and left panels 190 and 200 from main panel 114 as indicated by arrow A1. The right and left panels 190 and 200 are moved from their flat position to an upright position relative to main panel 114. The opening of the right and left panels 190 and 200 bring sub-panels 122 and 124 to an upright position (see FIG. 19). The sub-panels 122 and 124 foldably rotate about crease 134 and 136, respectively, as indicated by arrow A2 and A3 to achieve upright positions.

Figure 20:
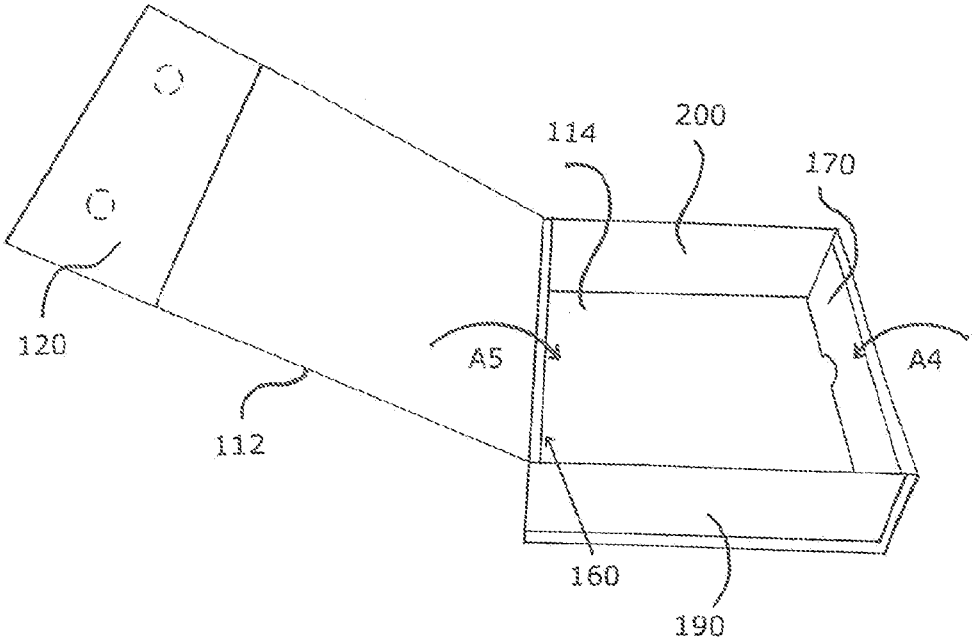
FIG. 20 is a perspective view of one implementation of the disclosed technology in its transition from a flat configuration to a three-dimensional configuration.
Figure 21:
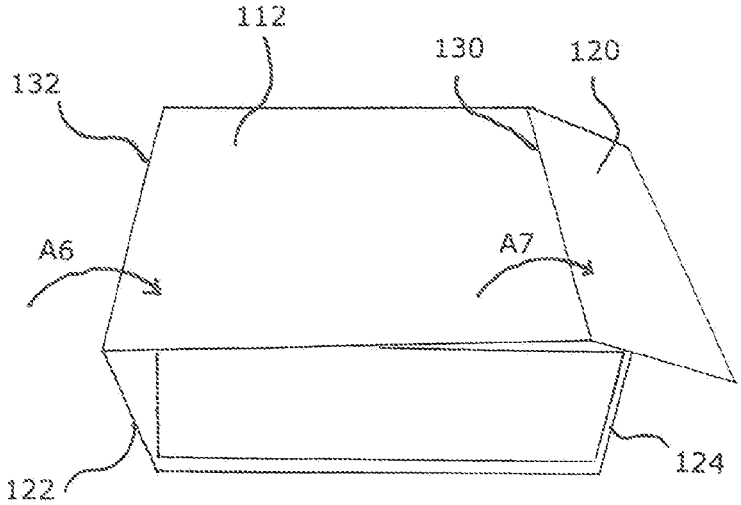
FIG. 21 is a perspective view of one implementation of the disclosed technology in its transition from a flat configuration to a three-dimensional configuration.

In a next step, as shown in FIG. 20, the rear support panel 160 is folded about crease 166 as indicated by arrow A5 and the front support panel 170 is folded about crease 176 as indicated by arrow A4. In this step, sub-panels 122 and 124 and right and left panels 190, 200 define the sides of the foldable box 100 with rear and front support panels supporting the upright positions of the sub-panels 122 and 124 and the right and left panels 190, 200 with the main panel 114 defining a base of the foldable box 100. In a next step, as shown in FIG. 21, the main panel 112 is folded about crease 132 as indicated by arrow A6. Main panel 112 defines a top of the box 100. In a next step, sub-panel 120 is foldably rotated about fold 130 as indicated by arrow A7 such that sub-panel 130 is positioned on sub-panel 124. Sub-panels 130 and 124 are lockable by magnetic forces between magnets. The box 100 in a three-dimensional configuration can be folded back to a flat state by following the above-mentioned steps in a reverse sequence.

The foldable box 100 is advantageously designed to provide a simple assembly method that allows a box to be easily folded from a flat state into a three-dimensional state. More importantly, once the box is in its three-dimensional state, the front support panel 170 and the rear support panel 160 securely lock the box in its three-dimensional state until the user manually unlocks the front support panel and the rear support panel from their locked positions and returns the box to its flat, folded state.

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A foldable box having a flat configuration and a three-dimensional configuration, comprising;

a first set of panels, the first set of panels having a first main panel, a second main panel, a first sub-panel, a second sub-panel and a third sub-panel, the first sub-panel being attached to the first main panel at a first crease, the second sub-panel being attached to the first main panel at a second crease, the second sub-panel being attached to the second main panel at a third crease, the third sub-panel being attached to the second main panel at a fourth crease;

a second set of panels, the second set of panels including a rear support panel having a first connecting tab foldably connected at a fifth crease and a front support panel having a second connecting tab foldably connected at a sixth crease, the rear support panel being attached to the second sub-panel with the fifth crease coinciding with the second crease, and the front support panel being attached to the third sub-panel with the sixth crease coinciding with an exterior edge of the third panel;

a third set of panels, the third set of panels including a right-side panel having a third connecting tab foldably connected at a seventh crease and a left-side panel having a fourth connecting tab foldably connected at an eighth crease, the right-side panel being attached to the second main panel with the seventh crease coinciding with a first exterior edge of the second main panel, and the left-side panel being attached to the second main panel with the eighth crease coinciding with a second exterior edge of the second main panel; and attachment tape, the attachment tape securing the first connecting tab, the second connecting tab, the third connecting tab and the fourth connecting tab to their respective panels, the attachment tape is further capable of reinforcing the third crease and the fourth crease.

2. The foldable box of claim 1, wherein the right-side panel includes two attachment wings foldably connected to the right-side panel, and the left-side panel includes two attachment wings foldably connected to the left-side panel, each attachment wing having a first triangular connector and a second triangular connector foldably connected to one another.

3. The foldable box of claim 2, wherein the second triangular connector of one of the attachment wings for the right-side panel is connected to the second sub-panel and the second triangular connector of the other attachment wing for the right-side panel is connected to the third sub-panel, wherein the second triangular connector of one of the attachment wings for the left-side panel is connected to the second sub-panel, and the second triangular connector of the other attachment wing for the left-side support panel is connected to the third sub-panel.

4. The foldable box of claim 1, further comprising:

a first magnet and a second magnet for securely closing the three-dimensional configuration of the foldable box, the first magnet and the second magnet having opposite poles.

5. The foldable box of claim 1, further comprising:

a first cut-out, the first cut-out being formed on a top edge of the rear support panel; and a second cut-out, the second cut-out being formed on a top edge of the front support panel, wherein the first cut-out and the second cut-out can be used to disassemble the three-dimensional configuration of the foldable box.

6. The foldable box of claim 1 further comprising:

reinforcement tape for reinforcing the first crease and the second crease.

7. The foldable box of claim 1, further comprising:

protection foam, the protection foam being secured to an underside of the first main panel.

8. A foldable box having a flat configuration and a three-dimensional configuration, comprising:

a first set of panels, the first set of panels having a first main panel, a second main panel, a first sub-panel, a second sub-panel and a third sub-panel, the first sub-panel being attached to the first main panel at a first crease, the second sub-panel being attached to the first main panel at a second crease, the second sub-panel being attached to the second main panel at a third crease, the third sub-panel being attached to the second main panel at a fourth crease;

a second set of panels, the second set of panels including a rear support panel having a first connecting tab foldably connected at a fifth crease and a front support panel having a second connecting tab foldably connected at a sixth crease, the rear support panel being attached to the second sub-panel with the fifth crease coinciding with the second crease, and the front support panel being attached to the third sub-panel with the sixth crease coinciding with an exterior edge of the third panel;

a third set of panels, the third set of panels including a right-side panel having a third connecting tab foldably connected at a seventh crease and a left-side panel having a fourth connecting tab foldably connected at an eighth crease, the right-side panel being attached to the second main panel with the seventh crease coinciding with a first exterior edge of the second main panel, and the left-side panel being attached to the second main panel with the eighth crease coinciding with a second exterior edge of the second main panel;

a first cut-out, the first cut-out being formed on a top edge of the rear support panel; and a second cut-out, the second cut-out being formed on a top edge of the front support panel, wherein the first cut-out and the second cut-out can be used to disassemble the three-dimensional configuration of the foldable box.

9. The foldable box of claim 8, further comprising:

attachment tape, the attachment tape securing the first connecting tab, the second connecting tab, the third connecting tab and the fourth connecting tab to their respective panels.

10. The foldable box of claim 9, wherein the attachment tape is capable of reinforcing the third crease and the fourth crease.

11. The foldable box of claim 8, wherein the right-side panel includes two attachment wings foldably connected to the right-side panel, and the left-side panel includes two attachment wings foldably connected to the left-side panel, each attachment wing having a first triangular connector and a second triangular connector foldably connected to one another.

12. The foldable box of claim 11, wherein the second triangular connector of one of the attachment wings for the right-side panel is connected to the second sub-panel and the second triangular connector of the other attachment wing for the right-side panel is connected to the third sub-panel, wherein the second triangular connector of one of the attachment wings for the left-side panel is connected to the second sub-panel, and the second triangular connector of the other attachment wing for the left-side support panel is connected to the third sub-panel.

13. The foldable box of claim 8, further comprising:

a first magnet and a second magnet for securely closing the three-dimensional configuration of the foldable box, the first magnet and the second magnet having opposite poles.

14. The foldable box of claim 8, further comprising:

reinforcement tape for reinforcing the first crease and the second crease.

15. The foldable box of claim 9, further comprising:

protection foam, the protection foam being secured to an underside of the first main panel.

* * * * *